US006415801B1

(12) United States Patent
Gallegos et al.

(10) Patent No.: US 6,415,801 B1
(45) Date of Patent: Jul. 9, 2002

(54) APPARATUS FOR ISOLATING HAIR FROM TREATMENT MATERIALS

(75) Inventors: Curtis M. Gallegos; Chantele Gallegos, both of San Clemente; Mark C. Gallegos, Torrance, all of CA (US)

(73) Assignee: Curtis Gallegos, San Clemente, CA (US)

( * ) Notice: Subject to any disclaimer, the term of this patent is extended or adjusted under 35 U.S.C. 154(b) by 0 days.

(21) Appl. No.: 09/549,219

(22) Filed: Apr. 13, 2000

(51) Int. Cl.[7] ..... A45D 19/18
(52) U.S. Cl. ..... 132/270; 132/252; 132/251
(58) Field of Search ..... 132/270, 248, 132/251, 226, 252, 259, 260, 254, 231, 229, 268

(56) References Cited

U.S. PATENT DOCUMENTS 3,470,888 A * 10/1969 Kuhn ..... 132/260
3,530,863 A * 9/1970 Foster ..... 132/252
3,881,500 A * 5/1975 Shinbashi et al. ..... 132/270
3,943,946 A * 3/1976 Gallegos ..... 132/248
4,526,184 A * 7/1985 Caruso ..... 132/251
5,323,792 A * 6/1994 Caruso ..... 132/251
5,365,953 A * 11/1994 Feughelman ..... 132/252
5,588,449 A * 12/1996 Falcon ..... 132/252

* cited by examiner

*Primary Examiner*—Pedro Philogene

(57) ABSTRACT

An improved apparatus for isolating sections of hair from hair treatment materials, the apparatus comprising an elongated curling rod on which a hair section is adapted to be wound, a sheet of material impermeable to the hair treatment materials adapted to overlie the hair section of for winding onto the curling rod with the hair section, and, a split sleeve sealing member adapted for fitting onto the curling rod in overlying relation to the wound up hair section and the sheet and operative to press upon and seal the hair section and the sheet from hair treatment materials, the split sleeve sealing member defining a pair of tabs extending radially outward from locations thereon, in spaced-apart arrangement, and adapted for squeezing together with the fingers of one hand to force the split sleeve apart sufficiently to place it over the wound up hair section on the curling rod without disturbing the wound up hair section.

3 Claims, 2 Drawing Sheets

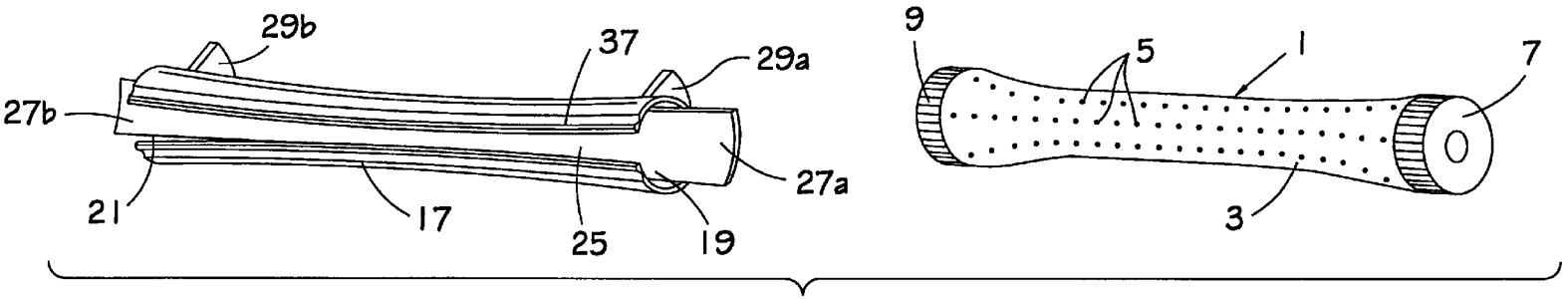
Fig. 1
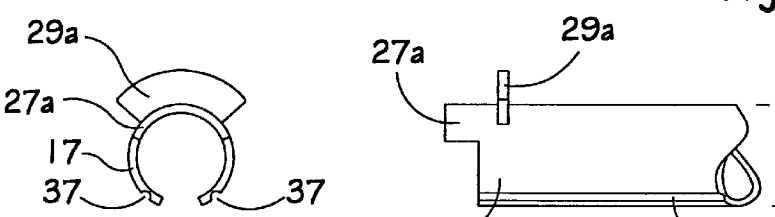
Fig. 3
Fig. 2
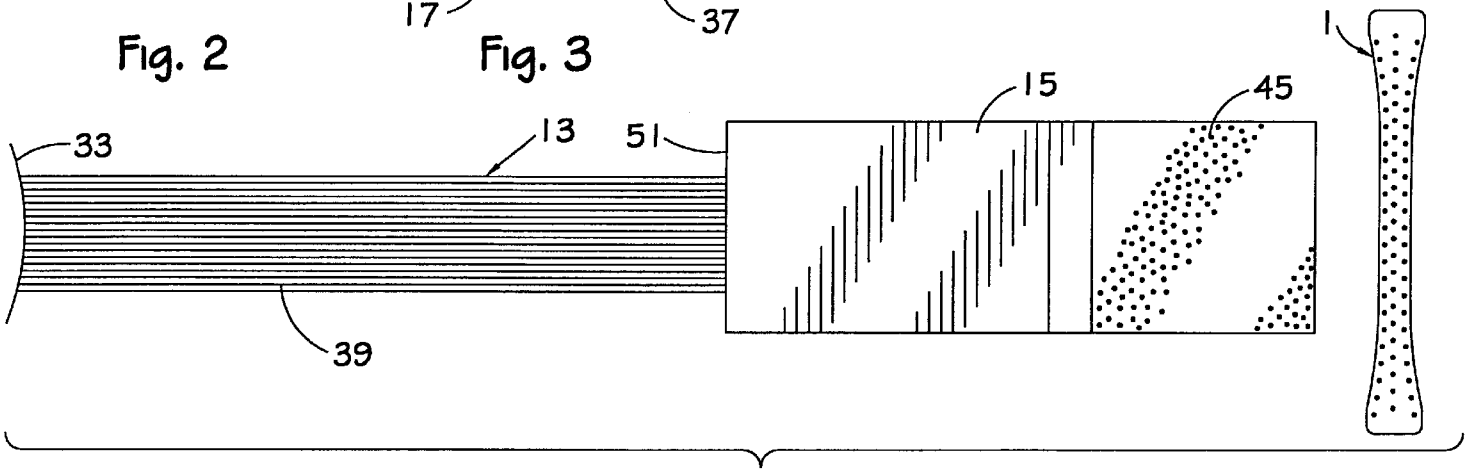
Fig. 4

APPARATUS FOR ISOLATING HAIR FROM TREATMENT MATERIALS

BACKGROUND OF THE INVENTION

1. Field of the Invention

This invention relates to the hair-treatment industry. More particularly, it pertains to an improved apparatus for isolating one or more sections of hair from the rest of a person's hair to prevent the isolated hair from exposure to chemicals such as bleach, dyes, curling solutions, and the like.

2. Description of the Prior Art

A person's hair continues to be a popular focal point for decorating and adorning to enhance one's beauty. While bleaching and dying remain popular along with various hair styles, there is continued emphasis to treating the hair with certain styling apparatus and colorants the end result of which is to have one's hair fashioned in two or more different colors. Along with this is the popular practice of curling straight hair and straightening curly hair. With each of these different styles, apparatus must be employed to separate some hair from other hair to insure against over-coloring, over-straightening, over-curling or other over-treatment.

U.S. Pat. No. 3,943,946, titled METHOD AND APPARATUS FOR ISOLATION OF HAIR FROM TREATMENT discloses the combination of an elongated winding member or curling rod, a sheet of material impermeable to hair treatment materials, and a sealing member, or split sleeve, where a section or tress of hair is covered with the sheet of material, wound upon the curling rod, and the split sleeve temporarily spread and placed over the wound hair to isolate that portion of the hair and render it impervious to treatment solutions applied to the remaining hair. This apparatus has proved to be somewhat popular. However, certain drawbacks have been experienced with the apparatus that has prevented widespread acceptance in the industry.

For instance, hair strands overlaying that hair wound on the curling rod tend to slip off the ends of the split sleeve and become mixed with other tresses of hair being treated. In addition, there is no indicator on the split sleeve to direct the hair dresser to begin placing the dye or bleach or other treatment liquid on the overlying hair. Further, the smoothness of the inside surface of the split sleeve, coupled with the fineness of some hair and slipperiness of some solution impervious material sheets, allows the split sleeve to slide longitudinally along the curling rod and uncover a portion of the hair rolled thereon. Finally, while the issued patent suggests polyethylene as a building material for the curling rod and the split sleeve, it has been found to have too slippery a surface, thereby allowing the hair to slip on the curling rod and become loose under the sleeve. This allows entrance of hair treatment solutions into the areas specifically isolated from such treatment materials and thus may mar the hair treatment and ruin its intended effect.

SUMMARY OF THE INVENTION

This invention is an improved apparatus for isolating sections of hair from hair treatment materials that overcomes all the disadvantages of the prior art set forth above. The invention comprises a hollow, elongated curling rod on which a hair section is adapted to be wound. The rod is externally and axially concave in order to establish a volume in which the wound hair may reside. A sheet or sheets of material, impermeable to the hair treatment materials, is adapted to be placed on the hair section to overlie it for winding, along with the hair section, onto the curling rod. A split sleeve, hollow, cylindrical sealing member is adapted for fitting over the curling rod and over the hair wound with the sheet of impermeable paper to press upon and seal the hair section and the sheet from other hair treatment materials later applied. A first pair of spaced-apart tabs are provided, each tab extending axially outward from a distal end of the split sleeve, for aid in prying off the split sleeve from the curling rod and the hair wound about it. A second pair of spaced-apart tabs are provided, each tab extending radially outward from exterior the split sleeve and inset from the first pair of spaced-apart tabs, for aid in preventing the hair overlying the split sleeve from sliding axially off the distal ends of the sleeve. Both the first and the second pairs of tabs remain exposed throughout the hair treatment process and allow better control of the hair overlying the split sleeve.

Another aspect of the invention is the providing of an axial bore, centralized in the curling rod for the purpose of temporarily receiving the "rat tail" or narrow diameter stub of a hair dresser's comb to provide further control over the curling rod when installing it and removing it from the hair of the customer.

Accordingly, the main object of this invention is a plurality of improvements on the apparatus for isolation of hair from treatment materials disclosed in U.S. Pat. No. 3,943,946 to allow more effective use thereof. Other objects of this invention include a means for improving the split sleeve to allow it to be installed and removed from the treatment area with greater ease than hereinbefore possible.

These and other objects of the invention will become more apparent upon reading the following Description of the Preferred Embodiment taken together with the drawings appended hereto. The scope of protection sought by the inventors herein may be gleaned from a fair reading of the claims that conclude this specification.

DESCRIPTION OF THE DRAWINGS

FIG. 1 is a perspective view of a typical curling rod and associated sealing or split sleeve according to the present invention;

FIG. 2 is an end view of the split sleeve of this invention showing the first and second pairs of tabs and how they are arranged on the sleeve;

FIG. 3 is a side view of one end of the split sleeve of this invention showing the first and second pairs of tabs and how they are arranged on the sleeve;

FIG. 4 is a partially diagrammatic plan view of a curling rod, and the hair section and papers which are wound together onto the rod;

DESCRIPTION OF THE PREFERRED EMBODIMENTS

Figure 5:
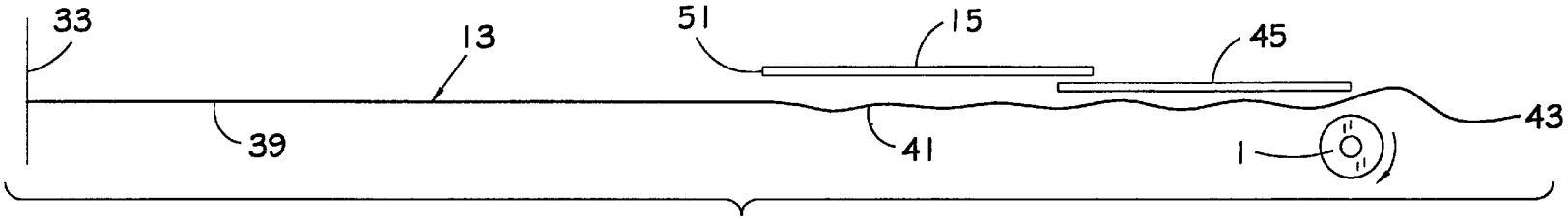
FIG. 5 is a side elevational view of the elements of FIG. 4.
Figure 6:
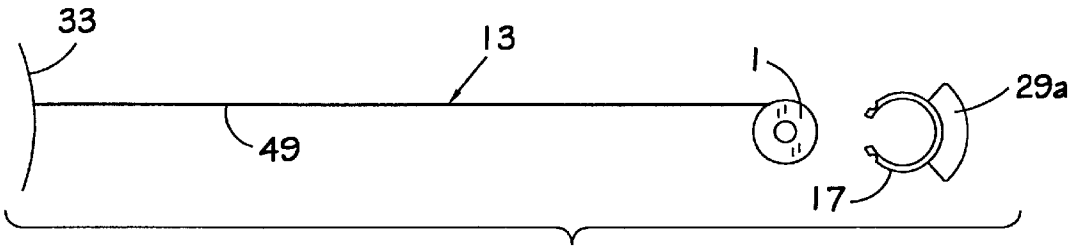
FIG. 6 is a view similar to FIG. 4, but illustrating the papers and a portion of the hair section wound upon the rod, with the sleeve of FIG. 1 ready to be fitted onto the wound elements.
Figure 7:
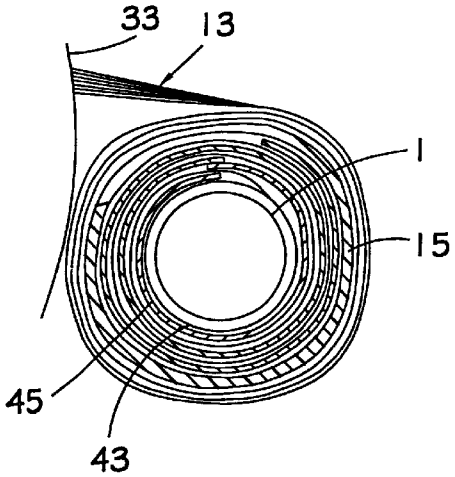
FIG. 7 is a partially diagrammatic cross-sectional view of the elements of FIG. 4 as the same would appear for a hair curling procedure; and, FIG. 8 is a partial perspective view of the elements of the present apparatus being utilized in a hair frosting procedure.

Because this invention is an improvement of U.S. Pat. No. 3,943,946, and the fact that the issued patent remains a public document, the specification and drawings thereof are incorporated herein by reference.

Turning now to the drawings, where elements or limitations are identified with numbers and like elements or limitations are identified with like numbers throughout the 8 figures, the invention is shown in FIG. 1 to comprise an elongated, hollow curling rod 1 defined by a rod body 3, on which a grip surface is formed containing a plurality of outwardly extending nubs or teeth 5, and further defined by a pair of spaced-apart first and second ends, 7 and 9 respectively, on which a hair section 13 is to be wound with a sheet of hair treating fluid impervious material 15. Rod body 3 is preferred to be externally concave as shown in FIGS. 1 and 4, in order to establish a volume to allow a space for hair section 13 and sheet material 15 to be wound thereabout. In addition, it is preferred that rod 1 be made hollow so that it may receive a short portion of the narrow diameter handle end of a typical "rat tail" comb thereby allowing the comb to be useful in supporting rod 1 during wrapping and unwrapping hair from about the rod.

While it has been previously proposed that rod 1 be made of polyethylene plastic in high-speed molding machines, that particular plastic forms a slippery surface that allows some of the hairs making up the hair section to slip out from the windings. Modernly, a higher friction material, somewhat tactile, and known as "MONPRENE" has been found to be useful in place of polyethylene or at least has been found to be useful as a cover for rod 1 when it is made of polyethylene plastic. Such a material may be obtained from QST, Inc., 300 Industrial Park Road, St. Albans, Vt. 05478.

Also as shown in FIG. 1, a piece of tubular plastic stock is fashioned into a sleeve 17, terminated by first and second distal ends 19 and 21, having a split or slit 25 formed completely therealong, for allowing sleeve 17 to be pried open to a greater diameter than its initial diameter and allow hair section 13, and a sheet of material 15, rolled up on rod 1, to pass therethrough prior to relaxing sleeve 17 and allowing it to form tightly against hair section 13, sheet material 15 and rod 1. Split sleeve 17 is adapted for fitting onto curling rod 1 in overlying relation to the wound up hair section 13 and sheet material 15 and operative to press upon and seal and protect hair section 13 and the sheet material 15 from hair treatment materials.

As shown in FIGS. 1, 2 and 3, a first pair of spaced-apart tabs, 27*a* and 27*b*, are provided, preferably formed as part of sleeve 17 and arranged with one said tab extending axially outward from each distal end 19 and 21 of split sleeve 17 beyond curling rod ends 7 and 9, so as to provide a free area for acceptance of a prying member thereunder to aid in prying off split sleeve 17 from curling rod 1 and the hair wound about it. Tabs 27*a* and 27*b* are preferably similarly clocked about sleeve 17 so that they each present the same picture to the hairdresser whether starting at one end of sleeve 17 or the other.

Figure 8:
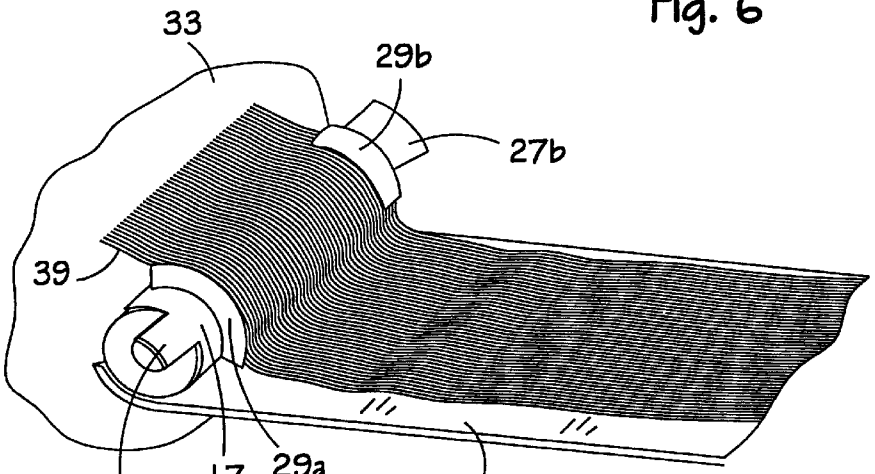

As shown in FIGS. 1–3, 6 and 8, a second pair of spaced-apart tabs, 29*a* and 29*b*, are provided, preferably formed as part of sleeve 17, each tab extending radially outward from and above exterior split sleeve 17 and inset from said first pair of spaced-apart tabs, 27*a* and 27*b*, for aid in preventing the hair overlying split sleeve 17 from sliding axially off the distal ends of the sleeve, such as shown in FIG. 8. Both first tabs 27*a* and 27*b* and second tabs 29*a* and 29*b* remain exposed throughout the hair treatment process and allow better control of the hair overlying split sleeve 17. Tabs 27*a* and 27*b* are likewise similarly clocked about sleeve 17 to provide mutual blocking of hair from either end of the sleeve.

As shown in FIG. 4, a section or tress 13 of hair is sectioned from the scalp 33 of the customer and overlaid with one or more sheets 15 of material, impermeable to the hair treatment materials and arranged to overlie hair section 13, prior to winding it onto curling rod 1. The composition of sheet 15 is not critical to the invention so long as it is impermeable to the particular hair treatment materials being used. A flexible parchment type paper is effective for this purpose.

As shown in FIGS. 1, 2, 3 and 6, a groove 37 is formed longitudinally in the outer surface of split sleeve 17 for indicating to the hair dresser the location of applying hair treatment solutions.

As shown in FIG. 4–7, a hair curling procedure is begun by separating or isolating a hair strand, tress, or section 13. For the purposes of this description, the hair section 13 has been divided into a root or scalp portion 39 which extends outwardly from scalp 33, a mid portion 41 which is covered in whole or in part by sheet 15, and a free end portion 43.

A conventional "end paper" 45 is placed upon end portion 43. As is well known to those skilled in the art, an end paper is a liquid absorbent, flexible and relatively soft material which facilitates attachment and winding of the end portion 43 upon curler rod 1. Curler rod 1 is rotated in a clockwise direction, as seen in FIG. 5, and the end paper and hair section catch upon the curler teeth 5 during the rolling or winding operation.

The hair section 13 is illustrated as having previously curled hair portions 41 and 43, which is typical, and a newly grown portion 49, which is straight. The object in a hair curling procedure is to avoid treating the previously curled portion of the hair section since this would tend to make them brittle and frizzy. Consequently, once the end portions 43 and the end paper 45 are partially rolled onto curler 1, fluid impermeable sheet 15 is used to protect the previously curled hair portions. For this purpose the sheet 15 is placed with its outer or trailing edge in a position generally overlying the line of demarcation between the curled and the uncurled portions of the hair section.

Clockwise winding of the curler rod 1 is continued until the curled hair portions 41 and 43 and the associated end paper 45 and sealing sheet 15 are completely rolled or wound upon curler rod 1. Split sleeve 17 is then pressed fitted over the wound materials on curler rod 1. One of the margins of the slot 25 is preferably located on or adjacent the sheet edge so that the bias of the sleeve material presses the edge into close conformity with the underlying wound materials. This effects a good seal against intrusion of the hair curling solution.

This procedure is repeated over all the hair that is to be treated. Then the treating fluid is applied. Groove 37 is useful in directing the hairdresser to place the fluid in the most effective location. Groove 37 is formed on each sleeve 17 thus giving the hairdresser a common location for placement of the fluid with each wrapped tress.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve substantially the same results are within the scope of this invention.

What is claimed is:

1. An improved apparatus for isolating sections of hair from hair treatment materials, said apparatus comprising:

a) an elongated curling rod on which a hair section is adapted to be wound;

b) a sheet of material impermeable to the hair treatment materials adapted to overlie the hair section for winding onto said curling rod with the hair section;

c) a split sleeve sealing member adapted for fitting onto said curling rod in overlying relation to the wound up hair section and said sheet and operative to press upon and seal the hair section and said sheet from hair treatment materials, said split sleeve sealing member defined by spaced-apart first and second distal ends;

d) a pair of spaced-apart tabs arranged with one said tab extending axially outward from each distal end of said split sleeve sealing member beyond said curling rod ends so as to provide a free area for acceptance of a prying member thereunder to aid in prying off said split sleeve sealing member from said curling rod and the hair wound about it; and, e) a groove formed in the outer surface of said split sleeve sealing member for indicating the location of applying hair treatment solutions.

2. An improved apparatus for isolating sections of hair from hair treatment materials, said apparatus comprising:

a) an elongated curling rod on which a hair section is adapted to be wound;

b) a sheet of material impermeable to the hair treatment materials adapted to overlie the hair section for winding onto said curling rod with the hair section;

c) a split sleeve sealing member adapted for fitting onto said curling rod in overlying relation to the wound up hair section and said sheet and operative to press upon and seal the hair section and said sheet of material from hair treatment materials, said split sleeve sealing member defined by spaced-apart first and second distal ends;

d) a pair of spaced-apart tabs, each said tab extending radially outward from and above said split sleeve sealing member and inset from said distal ends of said sleeve, for aid in preventing the hair overlying said split sleeve sealing member from sliding axially off the distal ends of said sleeve; and, e) a groove formed in the outer surface of said split sleeve sealing member for indicating the location of applying hair treatment solutions.

3. An improved apparatus for isolating sections of hair from hair treatment materials, said apparatus comprising:

a) an elongated curling rod on which a hair section is adapted to be wound;

b) a sheet of material impermeable to the hair treatment materials adapted to overlie the hair section for winding onto said curling rod with the hair section; and, c) a split sleeve sealing member adapted for fitting onto said curling rod in overlying relation to the wound up hair section and said sheet and operative to press upon and seal the hair section and said sheet from hair treatment materials, said split sleeve sealing member defined by spaced-apart first and second distal ends;

d) a first pair of spaced-apart tabs, formed as part of said split sleeve sealing member, arranged with one said tab extending axially outward from each distal end of said split sleeve sealing member beyond said curling rod ends so as to provide a free area for acceptance of a prying member thereunder to aid in prying off said split sleeve sealing member from said curling rod and the hair wound about it;

e) a second pair of spaced-apart tabs, formed as part of said split sleeve sealing member, each said tab extending radially outward from and above said split sleeve sealing member and inset from said first pair of spaced-apart tabs, for aid in preventing the hair overlying said split sleeve sealing member from sliding axially off the distal ends of said split sleeve sealing member; and, f) a groove formed in the outer surface of said split sleeve sealing member for indicating the location of applying hair treatment solutions.

* * * * *